US011004397B2

(12) United States Patent
Kobayashi et al.

(10) Patent No.: US 11,004,397 B2
(45) Date of Patent: May 11, 2021

(54) DISPLAY DEVICE AND METHOD FOR DRIVING SAME

(71) Applicant: Sharp Kabushiki Kaisha, Sakai (JP)

(72) Inventors: Fumiyuki Kobayashi, Sakai (JP); Tamotsu Sakai, Sakai (JP); Shigetsugu Yamanaka, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 189 days.

(21) Appl. No.: 16/468,399

(22) PCT Filed: Sep. 21, 2017

(86) PCT No.: PCT/JP2017/034024
§ 371 (c)(1),
(2) Date: Jun. 11, 2019

(87) PCT Pub. No.: WO2019/058474
PCT Pub. Date: Mar. 28, 2019

(65) Prior Publication Data
US 2021/0110773 A1 Apr. 15, 2021

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01)

(58) Field of Classification Search
CPC ... G09G 3/3233; G09G 3/3225; G09G 3/3266
See application file for complete search history.

(56) References Cited

U.S. PATENT DOCUMENTS 9,576,532 B2 2/2017 Lee
2004/0217925 A1* 11/2004 Chung ..... G09G 3/3233 345/76

(Continued)

FOREIGN PATENT DOCUMENTS

JP 2004-334163 A 11/2004
JP 2008-197607 A 8/2008
JP 2009-276744 A 11/2009

OTHER PUBLICATIONS

Official Communication issued in International Patent Application No. PCT/JP2017/034024, dated Dec. 26, 2017.

(Continued)

*Primary Examiner* — Sepehr Azari
(74) *Attorney, Agent, or Firm* — Keating & Bennett, LLP

(57) ABSTRACT

Provided is a pixel circuit including: an electro-optical element, a driving transistor; a writing control transistor whose first conduction terminal is connected to a data line and whose control terminal is connected to a scanning line; and an initialization transistor whose first conduction terminal is connected to a control terminal of the driving transistor, to whose second conduction terminal an initialization voltage is applied, and whose control terminal is connected to a first control line. In a case of a P-channel transistor, a high-level voltage to be given to the control terminal of the initialization transistor is lower than a high-level voltage to be given to the control terminal of the writing control transistor.

14 Claims, 8 Drawing Sheets

(56) References Cited

U.S. PATENT DOCUMENTS

| | | | | |
|---|---|---|---|---|
| 2009/0201231 | A1* | 8/2009 | Takahara | G09G 3/3233 345/76 |
| 2018/0166010 | A1* | 6/2018 | Park | G09G 3/3233 |

OTHER PUBLICATIONS

Komiya et al., "Comparison of Vth compensation ability among voltage programming circuits for AM-OLED panels", Proceedings of International Display Workshops, vol. 10, 2003.pp. 275-278.

* cited by examiner

DISPLAY DEVICE AND METHOD FOR DRIVING SAME

TECHNICAL FIELD

The disclosure relates to a display device. In particular, it relates to a display device that includes a pixel circuit including an electro-optical element.

BACKGROUND ART

Organic EL display devices including pixel circuits including organic electro luminescence (hereinafter referred to as "EL") elements have recently been coming into practical use. The pixel circuit of the organic EL display device includes not only the organic EL elements but also driving transistors, writing control transistors, and the like. Thin film transistors (hereinafter referred to as a "TFTs") are used as these transistors. The organic EL elements are a type of electro-optical elements, and emit light of luminance in accordance with the amount of electric current that flows. Each of the driving transistors is arranged in series with the corresponding organic EL element, and regulates the amount of electric current that flows through the organic EL element.

The characteristics of the organic EL elements and the characteristics of the driving transistors vary from one element/transistor to another, and fluctuate over time. Hence, for the purpose of making the organic EL display device display images of high picture quality, it is necessary to compensate the variation and the fluctuation of the elements. There are two known methods of compensating the characteristics of the elements in the organic EL display device: compensation performed within the pixel circuit; and compensation performed outside the pixel circuit. In the former method, there may be a case where a process for initialize the voltage of the control terminal of the driving transistor to a predetermined level is performed before inputting a voltage (hereinafter referred to as the "data voltage") into the pixel circuit in accordance with the image signal. In such a case, an initialization transistor is provided in the pixel circuit.

Many pixel circuits including organic EL elements have been proposed so far. For example, PTL 1 describes a pixel circuit 91 illustrated in FIG. 10, and NPL 1 describes a pixel circuit 92 illustrated in FIG. 11. Note that to facilitate the comparison with the disclosure of the present application, names of the elements and signal lines in FIG. 10 and FIG. 11 are changed from their respective names used in their original pixel circuits.

The pixel circuit 91 illustrated in FIG. 10 includes seven TFTs, that is, a TFT TR11 to a TFT TR17. The TFT TR11, the TFT TR15, and the TFT TR13 function as a driving transistor, a writing control transistor, and an initialization transistor, respectively. The gate terminal of the TFT TR15 and the gate terminal of the TFT TR13 are connected respectively to a scanning line Gi and a control line Pi.

The pixel circuit 92 illustrated in FIG. 11 includes five TFTs, that is, a TFT TR21 to a TFT TR25. The TFT TR21, the TFT TR23, and the TFT TR25 function as a driving transistor, a writing control transistor, and an initialization transistor, respectively. The gate terminal of the TFT TR23 and the gate terminal of the TFT TR25 are connected respectively to a scanning line Gi and a scanning line Gi-1.

CITATION LIST

Patent Literature

PTL 1: U.S. Pat. No. 9,576,532 B2

Non-Patent Literature

NPL 1: N. Komiya et al., "Comparison of Vth compensation ability among voltage programming circuits for AM-OLED panels", Proceedings of International Display Workshops, Vol. 10, pp. 275-278, 2003

SUMMARY

Technical Problem

In the light emission period of the organic EL elements provided in the pixel circuit 91, a high-level voltage is applied to the scanning line Gi and the control line Pi to turn the TFT TR15 and the TFT TR13 off. In the display device of a related art, the high-level voltage applied to the scanning line Gi and the high-level voltage applied to the control line Pi are voltages of the same level. Hence, the off-current of the TFT TR13 may vary, resulting in a bright spot in the display screen (to be described in detail later).

In the light emission period of the organic EL elements provided in the pixel circuit 92, a high-level voltage is applied to the scanning lines Gi and Gi-1 to turn the TFT TR23 and the TFT TR25 off. In the display device of a related art, the high-level voltage applied to the scanning lines Gi and Gi-1 are voltages of the same level. Hence, the off-current of the TFT TR25 may vary, resulting in a bright spot in the display screen (to be described in detail later).

Accordingly, a challenge arises: providing a display device capable of suppressing the occurrence of bright spots on the display screen due to the variation of the off-current of the initialization transistor.

Solution to Problem

A solution to the challenge is provided, for example, by a display device including: a display portion including a plurality of scanning lines, a plurality of data lines, a plurality of control lines, and a plurality of pixel circuits; a scanning line drive circuit configured to drive the plurality of scanning lines; a data line drive circuit configured to drive the plurality of data lines; and a control line drive circuit configured to drive the plurality of control lines. In the display device, each of the plurality of pixel circuits includes an electro-optical element, a driving transistor, a writing control transistor, and an initialization transistor. The electro-optical element is disposed on a route connecting a first conductive member and a second conductive member and is configured to emit light of a luminance in accordance with an electric current flowing through the route. Both the first conductive member and the second conductive member are configured to supply a power source voltage. The driving transistor is disposed on the route in series with the electro-optical element and is configured to regulate an amount of the electric current flowing through the route. The writing control transistor includes: a first conduction terminal connected to a data line of the plurality of data lines; and a control terminal connected to a scanning line of the plurality of scanning lines. The initialization transistor includes: a first conduction terminal connected to a control terminal of the driving transistor; a second conduction terminal to which an initialization voltage is applied; and a control terminal connected to a first control line included in the plurality of control lines. The writing control transistor and the initialization transistor have the same polarity. An off-voltage to be given to the control terminal of the initialization transistor is closer to an on-voltage than an off-voltage to be given to the control terminal of the writing control transistor.

Another solution to the challenge is provided by a display device driving method for driving a display device including the above-described display portion. The display device driving method includes: driving the plurality of scanning lines; driving the plurality of data lines; and driving the plurality of control lines. The writing control transistor and the initialization transistor have the same polarity. An off-voltage to be given to the control terminal of the initialization transistor is closer to an on-voltage than an off-voltage to be given to the control terminal of the writing control transistor.

Advantage Effects of Disclosure

According to the display device and the method of driving the display device, an off-voltage to be given to the control terminal of the initialization transistor is closer to an on-voltage than an off-voltage to be given to the control terminal of the writing control transistor. Hence, the voltage between the gate and the source (gate-source voltage) at the time when the initialization transistor is in the off state becomes lower than otherwise, the variation in the off-current of the initialization transistor is suppressed, and the occurrence of bright spots on the display screen is suppressed.

DESCRIPTION OF EMBODIMENTS

Figure 1:
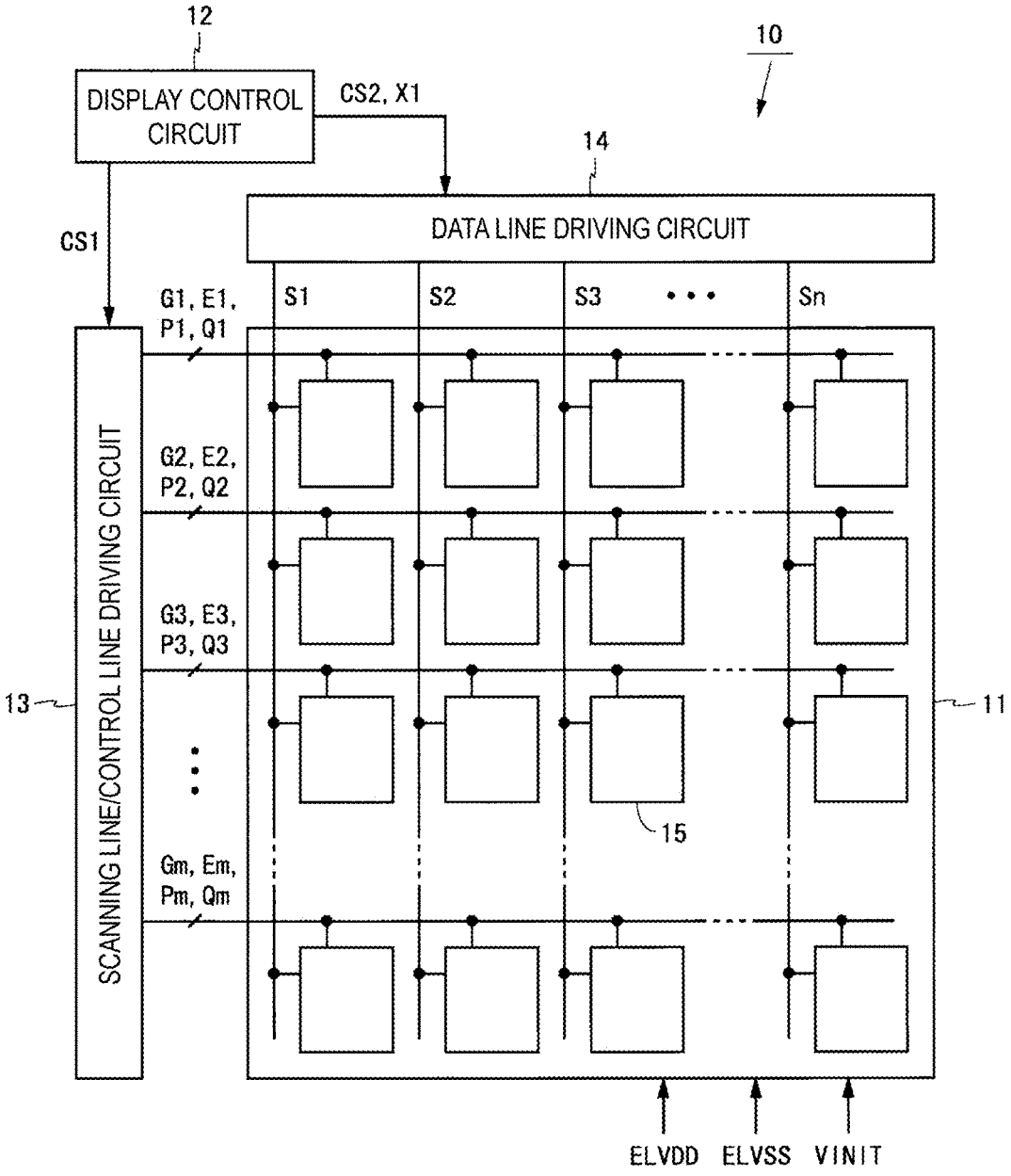
FIG. 1 is a block diagram illustrating a configuration of a display device according to a first embodiment.

Display devices according to some embodiments will be described below with reference to the drawings. The display device according to each of the embodiments is an organic EL display device equipped with pixel circuits each of which includes an organic EL element. The organic EL element is a kind of electro-optical elements, and is also referred to as an organic light emitting diode, or an OLED. In the following description, the horizontal direction in the drawings is referred to as the "row direction", and the vertical direction in the drawings is referred to as the "column direction". In addition, each of the letters m and n represents an integer that is equal to or larger than 2, the letter i represents an integer that is equal to or larger than 1 and is equal to or smaller than m, and the letter j represents an integer that is equal to or larger than 1 and is equal to or smaller than n.

First Embodiment

FIG. 1 is a block diagram illustrating a configuration of a display device according to a first embodiment. A display device 10 illustrated in FIG. 1 includes a display portion 11, a display control circuit 12, a scanning line/control line drive circuit 13, and a data line drive circuit 14. The scanning line/control line drive circuit 13 is a combination circuit that combines a scanning line drive circuit configured to drive scanning lines and a control line drive circuit configured to drive control lines. The term "scanning line/control line drive circuit" means both the scanning line drive circuit and the control line drive circuit.

The display portion 11 includes: m scanning lines G1 to Gm; n data lines S1 to Sn; 3*m* control lines E1 to Em, P1 to Pm, and Q1 to Qm; and (m×n) pixel circuits 15. The scanning lines G1 to Gm extend in the row direction, and are arranged in parallel to one another. The data lines S1 to Sn extend in the column direction, and are arranged in parallel to one another and orthogonally to the scanning lines G1 to Gm. The scanning lines G1 to Gm and the data lines S1 to Sn intersect at (m×n) locations. The (m×n) pixel circuits 15 are arranged in a 2D manner and correspond to the intersection points of the scanning line G1 to Gm and the data lines S1 to Sn. The control lines E1 to Em, P1 to Pm, and Q1 to Qm are arranged in parallel to the scanning lines G1 to Gm. To each of the pixel circuits 15, three different voltages (i.e., a high-level power source voltage ELVDD, a low-level power source voltage ELVSS, and an initialization voltage VINIT) are fixedly supplied by use of an unillustrated wiring line or electrode. The following description assumes that the high-level power source voltage ELVDD is supplied through a high-level power-source voltage wiring line and that the low-level power source voltage ELVSS is supplied through a common electrode.

The display control circuit 12 outputs a control signal CS1 to the scanning line/control line drive circuit 13, and also outputs both a control signal CS2 and an image signal X1 to the data line drive circuit 14. Based on the control signal CS1, the scanning line/control line drive circuit 13 drives the scanning lines G1 to Gm and the control lines E1 to Em, P1 to Pm, and Q1 to Qm. Based on both the control signal CS2 and the image signal X1, the data line drive circuit 14 drives the data line S1 to Sn. To be more specific, in the ith line period, the scanning line/control line drive circuit 13 applies an on-voltage (a voltage to turn the TFT on, in this case, a low-level voltage) to the ith scanning line Gi, and also applies an off-voltage (a voltage to turn the TFT off, in this case a high-level voltage) to the other (m−1) scanning lines. Hence, in the ith line period, the pixel circuits 15 in the ith row are selected in a batch manner. Based on the control signal CS2, the data line drive circuit 14 applies n data voltages in accordance with the image signal X1 to the data lines S1 to Sn. Hence, in the ith line period, n data voltages are inputted into their corresponding pixel circuits 15 in the ith row.

Figure 2:
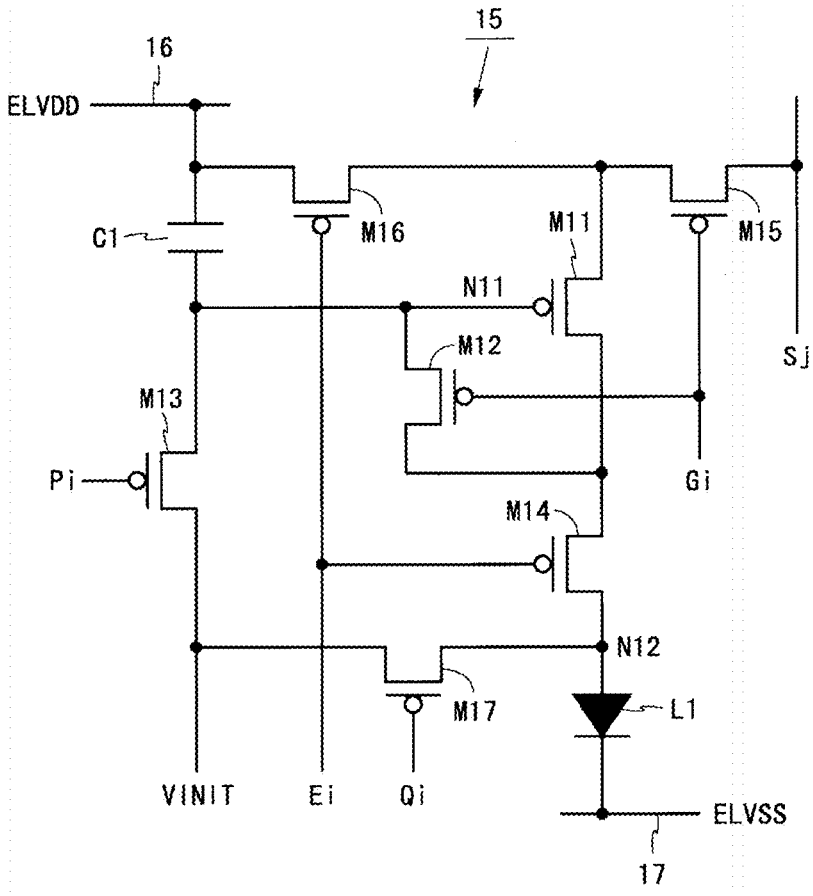
FIG. 2 is a circuit diagram illustrating a pixel circuit of the display device illustrated in FIG. 1.

FIG. 2 is a circuit diagram illustrating the pixel circuit 15. FIG. 2 illustrates a pixel circuit 15 located in the ith row and the jth column. The pixel circuit 15 illustrated in FIG. 2 includes: an organic EL element L1; seven TFTs M11 to M17; and a capacitor C1. The pixel circuit 15 is connected to: the scanning line Gi; the control lines Ei, Pi, and Qi; and the data line Sj. The TFTs M11 to M17 are P-channel transistors.

Note that each of the TFTs included in the pixel circuit 15 may be an amorphous silicon transistor including a channel layer made from an amorphous silicon, a low-temperature polysilicon transistor including a channel layer made from a low-temperature polysilicon, or an oxide semiconductor transistor including a channel layer made from an oxide semiconductor. The oxide semiconductor may be, for example, indium gallium zinc oxide (also referred to as "IGZO"). Each of the TFTs included in the pixel circuit 15 may be a TFT of the top-gate type or a TFT of the bottom-gate type.

The source terminal of the TFT M16 and a first one of the electrodes of the capacitor C1 (the upper-side electrode one in FIG. 2) are connected to a high-level power-source voltage wiring line 16 configured to supply the high-level power source voltage ELVDD. The TFT M15 includes a first conduction terminal (the right-hand side terminal in FIG. 2) connected to the data line Sj. The drain terminal of the TFT M16 and the second conduction terminal of the TFT M15 are connected to the source terminal of the TFT M11. The drain terminal of the TFT M11 is connected to the first conduction terminal of the TFT M12 (the lower-side terminal in FIG. 2) and the source terminal of the TFT M14. The drain terminal of the TFT M14 is connected to the anode terminal of the organic EL element L1 and a first conduction terminal (the right-hand side terminal in FIG. 2) of the TFT M17. The cathode terminal of the organic EL element L1 is connected to a common electrode 17 configured to supply the low-level power source voltage ELVSS. The gate terminal of the TFT M11 is connected to a second conduction terminal of the TFT M12, a second one of the electrodes of the capacitor C1, and a first conduction terminal of the TFT M13 (the upper-side terminal in FIG. 2). The initialization voltage VINIT is applied to the second conduction terminal of the TFT M13 and the second conduction terminal of the TFT M17. The gate terminal of the TFT M12 and the gate terminal of the TFT M15 are connected to the scanning line Gi. The gate terminal of the TFT M14 and the gate terminal of the TFR M16 are connected to the control line Ei. The gate terminal of the TFT M13 is connected to the control line Pi. The gate terminal of the TFT M17 is connected to the control line Qi. The high-level power-source voltage wiring line 16 functions as a first conductive member configured to supply the high-level power source voltage ELVDD. The common electrode 17 serves as a second conductive member configured to supply the low-level power source voltage ELVSS. Hereinafter the node to which the gate terminal of the TFT M11 is connected is referred to as the "node N11", and the node to which the anode terminal of the organic EL element L1 is connected is referred to as the "node N12".

The organic EL element L1 is disposed on the route connecting the first and the second conductive members (i.e., the high-level power-source voltage wiring line 16 and the common electrode 17) configured to supply their respective power source voltages. The organic EL element L1 thus functions as an electro-optical element configured to emit light of luminance in accordance with the amount of electric current that flows through the route. The TFT M11 is disposed on the route in series with the electro-optical element, and functions as a driving transistor configured to regulate the amount of electric current flowing through the route. The TFT M15 functions as a writing control transistor whose first conduction terminal is connected to the data line Sj and whose control terminal is connected to the scanning line Gi. The TFT M13 functions as an initialization transistor whose first conduction terminal is connected to the control terminal of the driving transistor, whose second conduction terminal is applied with the initialization voltage VINIT, and whose control terminal is connected to a first control line (i.e., the control line Pi). The writing control transistor and the initialization transistor have the same polarity.

The first conduction terminal of the driving transistor is connected to the second conduction terminal of the writing control transistor. The TFT M12 functions as a threshold compensation transistor whose first conduction terminal is connected to the second conduction terminal of the driving transistor, whose second conduction terminal is connected to the control terminal of the driving transistor, and whose control terminal is connected to the scanning line Gi. The TFT M16 functions as a first light-emission control transistor whose first conduction terminal is connected to the first conductive member, whose second conduction terminal is connected to the first conduction terminal of the driving transistor, and whose control terminal is connected to a light-emission control line (i.e., control line Ei). The TFT M14 functions as a second light-emission control transistor whose first conduction terminal is connected to the second conduction terminal of the driving transistor, whose second conduction terminal is connected to a first one of the terminals of the electro-optical circuit, and whose control terminal is connected to the light-emission control line. The capacitor C1 is disposed between the first conductive member and the control terminal of the driving transistor. The TFT M17 functions as a second initialization transistor whose first conduction terminal is connected to a first one of the terminals of the electro-optical circuit, whose second conduction terminal is applied with the initialization voltage, and whose control terminal is connected to a second control line (i.e., the control line Qi).

Figure 3:
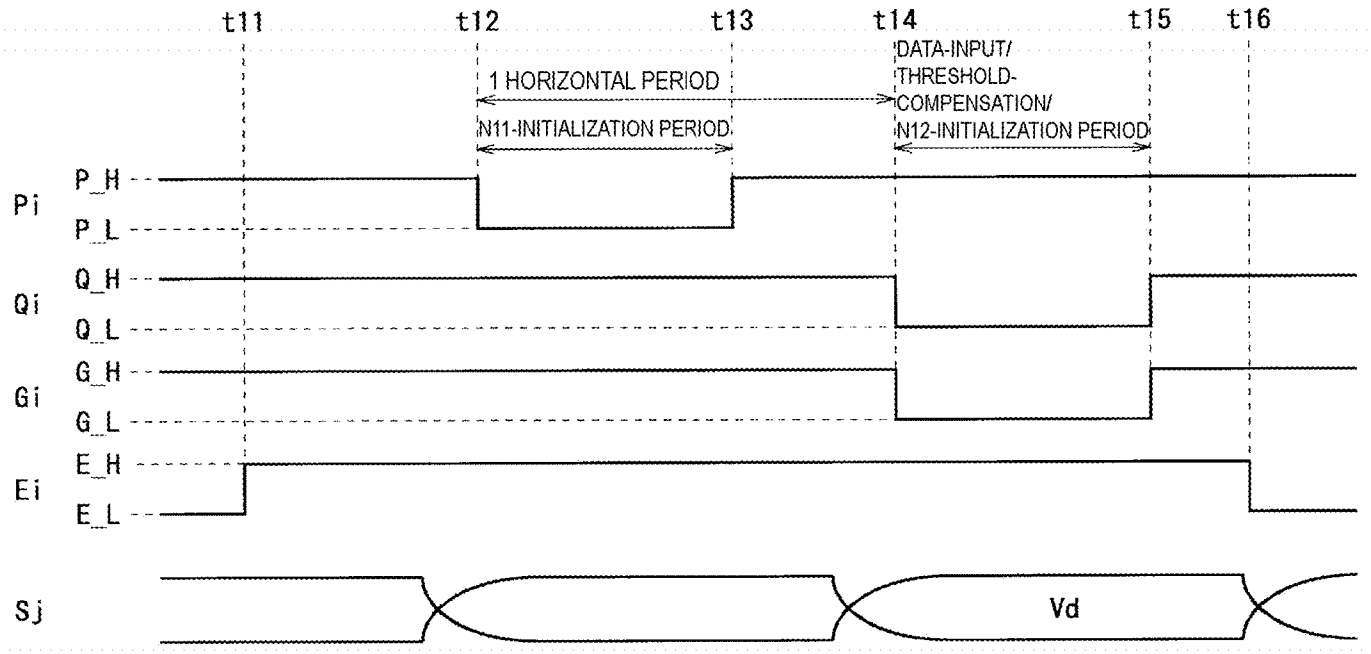
FIG. 3 is a timing chart for the display device illustrated in FIG. 1.

FIG. 3 is a timing chart for the display device 10. FIG. 3 illustrates the voltage changes at the time when data voltage is inputted into a pixel circuit 15 located in the ith row and jth column. The period from the time t12 to the time t14 in FIG. 3 corresponds to a single horizontal period. The period from the time t12 to the time t13 is a period when the voltage of the node N11 is initialized (N11-initialization period). The period from the time t14 to the time t15 is a period when: the data voltage is inputted and a threshold compensation is performed, and the voltage of the node N12 is initialized (data-input/threshold-compensation/N12-initialization period, hereinafter simply referred to as the "compensation period").

Hereinafter, the signal on the scanning line Gi is referred to as a "scanning signal Gi", and the signals on the control lines Ei, Pi, and Qi are referred to as "control signals Ei, Pi, and Qi", respectively. As illustrated in FIG. 3, the control signal Pi is at the low level during the N11-initialization period, and is at the high level during the other period. The scanning signal Gi and the control signal Qi are at the low level during the compensation period, and are at the high level during the other period. The control signal Ei is at the high level during the period from the time t11 to the end of the compensation period, and is at the low level during the other period. While the control signal Ei is at the low level, the organic EL element L1 in each of the pixel circuits 15 in the ith row emits light of the luminance in accordance with the data voltage inputted into the pixel circuits 15.

Prior to the time t11, the scanning signal Gi and the control signals Pi and Qi are at the high level, whereas the control signal Ei is at the low level. Hence, the TFTs M14 and M16 are in the ON state, whereas the TFTs M12, M13, M15, and M17 are in the OFF state. During the above-described period, in a case where the TFT M11 has a gate-source voltage of not higher than the threshold voltage, a current flows from the high-level power-source voltage wiring line 16 to the common electrode 17 through the TFTs M16, M11, and M14 as well as through the organic EL element L1. Hence, the organic EL element L1 emits light of the luminance in accordance with the electric current that flows.

At the time t11, the control signal Ei is switched to the high level. In response to the switching, the TFTs M14 and M16 are turned OFF. Hence, from the time t11 onwards, no electric current flows through the organic EL element L1, and thus the organic EL element L1 emits no light at all.

Then at the time t12, the control signal Pi is switched to the low level. In response to the switching, the TFT M13 is turned ON. Hence, the gate voltage of the TFT M11 is initialized to the initialization voltage VINIT. The initialization voltage VINIT is set to a low enough level to allow the TFT M11 to be turned ON immediately after the switching of the scanning signal Gi to the low level.

Then at the time t13, the control signal Pi is switched to the high level. In response to the switching, the TFT M13 is turned OFF. Hence, from the time t13 onwards, no initialization voltage VINIT is applied to the gate terminal of the TFT M11.

Then at the time t14, the scanning signal Gi and the control signal Qi are switched to the low level. In response to the switching, the TFTs M12, M15, and M17 are turned ON. From the time t14 onwards, the gate terminal and the drain terminal of the TFT M11 are electrically connected to each other through the TFT M12 that is in the ON state. Hence, the TFT M11 is in a diode-connected state. Consequently, an electric current flows from the data line Sj to the gate terminal of the TFT M11, through the TFTs M15, M11, and M12. The gate voltage of the TFT M11 is raised by this electric current. Once the gate-source voltage of the TFT M11 reaches the threshold voltage of the TFT M11, no electric current flows. The gate voltage of the TFT M11 a sufficient time after the time t14 is represented by (Vd−|Vth_M11|), where Vth_M11(<0) is the threshold voltage of the TFT M11, and Vd is the voltage of the data line Sj during the compensation period. In addition, as the TFT M17 is turned ON at the time t14, the voltage of the anode terminal of the organic EL element L1 is initialized to the initialization voltage VINIT.

Then at the time t15, the scanning signal Gi and the control signal Qi are switched to the high level. In response to the switching, the TFTs M12, M15, and M17 are turned OFF. From the time t15 onwards, the capacitor C1 keeps the inter-electrode voltage (ELVDD−Vd+|Vth_M11|). In addition, no initialization voltage VINIT is applied to the anode terminal of the organic EL element L1 any longer.

Then at the time t16, the control signal Ei is switched to the low level. In response to the switching, the TFT M14 and M16 are turned ON. From the time t16 onwards, an electric current flows from the high-level power-source voltage wiring line 16 to the common electrode 17 through the TFTs M16, M11, and M14 and through the organic EL element L1. The gate-source voltage Vgs of the TFT M11 is kept at (ELVDD−Vd+|Vth_M11|) by the operation of the capacitor C1. Hence, the electric current I1 that flows from the time t16 onwards is given by Equation (1) below with a constant K:

$$I1=K(Vgs-|Vth_M11|)^2=K(\mathrm{ELVDD}-Vd)^2 \quad (1)$$

Hence, from the time t16 onwards, the organic EL element L1 emits light of luminance in accordance with the data voltage Vd inputted into the pixel circuit 15 irrespective of the threshold voltage Vth_M11 of the TFT M11.

Hereinafter, the high-level voltage to be applied to the scanning lines G1 to Gm is denoted by G_H, whereas the high-level voltage to be applied to the control lines P1 to Pm is denoted by P_H. In the display device 10, the high-level voltage P_H is set to a value that is lower than the high-level voltage G_H (P_H<G_H). To put it differently, in comparison to the off-voltage G_H to be given to the control terminal of the writing control transistor (i.e., TFT M15), the off-voltage P_H to be given to the control terminal of the initialization transistor (i.e., TFT M13) is set relatively close to the on-voltage (i.e., low-level voltage).

The high-level voltage P_H is set, for example, so that the difference between the high-level voltage P_H and the on-voltage corresponds to the average value of the threshold voltages Vth_M11 of all the TFT M11 included in the display portion 11. For example, the difference between the high-level voltage P_H and the on-voltage is set to substantially the same as the average value of the threshold voltages Vth_M11 of all the TFTs M11 included in the display portion 11. The threshold voltage Vth_M11 has an absolute value of, for example, approximately from 3 to 8 V.

An effect that the display device 10 of the present embodiment has is described below by comparing the display device 10 with a display device with the two high-level voltages P_H and the G_H being at the same level (hereinafter, referred to as a "known display device"). For both the known display device and the display device 10, the condition for turning OFF the TFT M15 is given by Relationship (2) below, and the condition for turning OFF the TFT M13 is given by Relationship (3) below:

$$G_H-\max(\mathrm{ELVDD},Vd)>Vth_M15 \quad (2)$$

$$P_H-Vn11>Vth_M13 \quad (3)$$

In Relationships (2) and (3) above, Vn11 is the voltage of the node N11, Vth_M13 is the threshold voltage of the TFT M13, and Vth_M15 is the threshold voltage of the TFT M15.

During the compensation period, the TFT M11 is in the diode-connected state. Hence, the gate voltage of the TFT M11 during the compensation period is given by Equation (4) below:

$$Vn11=Vd-|Vth_M11| \quad (4)$$

In the case of the known display device, the two high-level voltages are equal to each other (i.e., P_H=G_H). Hence, in a case where the threshold voltage Vth_M13 of the TFT M13 and the threshold voltage Vth_M15 of the TFT M15 are approximately equal to each other, the gate-source voltage at the time of being turned OFF is higher for the TFT M13 than for the TFT M15. Hence, the off current for the TFT M13 is more likely to vary. Consequently, bright spots may occur in the display screen.

In contrast, in the case of the display device 10 the two high-level voltages have a relation of P_H<G_H. Hence, even in a case where the threshold voltage Vth_M13 of the TFT M13 and the threshold voltage Vth_M15 of the TFT M15 are approximately equal to each other, the gate-source voltage of the TFT M13 at the time of being turned OFF is reduced and thus the variation in the off-current for the TFT M13 is suppressed. Hence, the display device 10 according to the present embodiment reduces the variation in the off-current for the initialization transistor (i.e., TFT M13) configured to initialize the voltage of the control terminal of the driving transistor (i.e., gate terminal of the TFT M11), and thus suppresses the occurrence of bright spots on the display screen.

In addition, as the pixel circuit 15 includes the TFT M17, the voltage of the anode terminal of the organic EL element L1 is initialized by use of the initialization voltage VINIT to be applied to the gate terminal of the TFT M11. Note that a display device according to a modified example of the present embodiment may be provided as a display device including a pixel circuit obtained by removing the TFT M17 from the pixel circuit 15.

Second Embodiment

Figure 4:
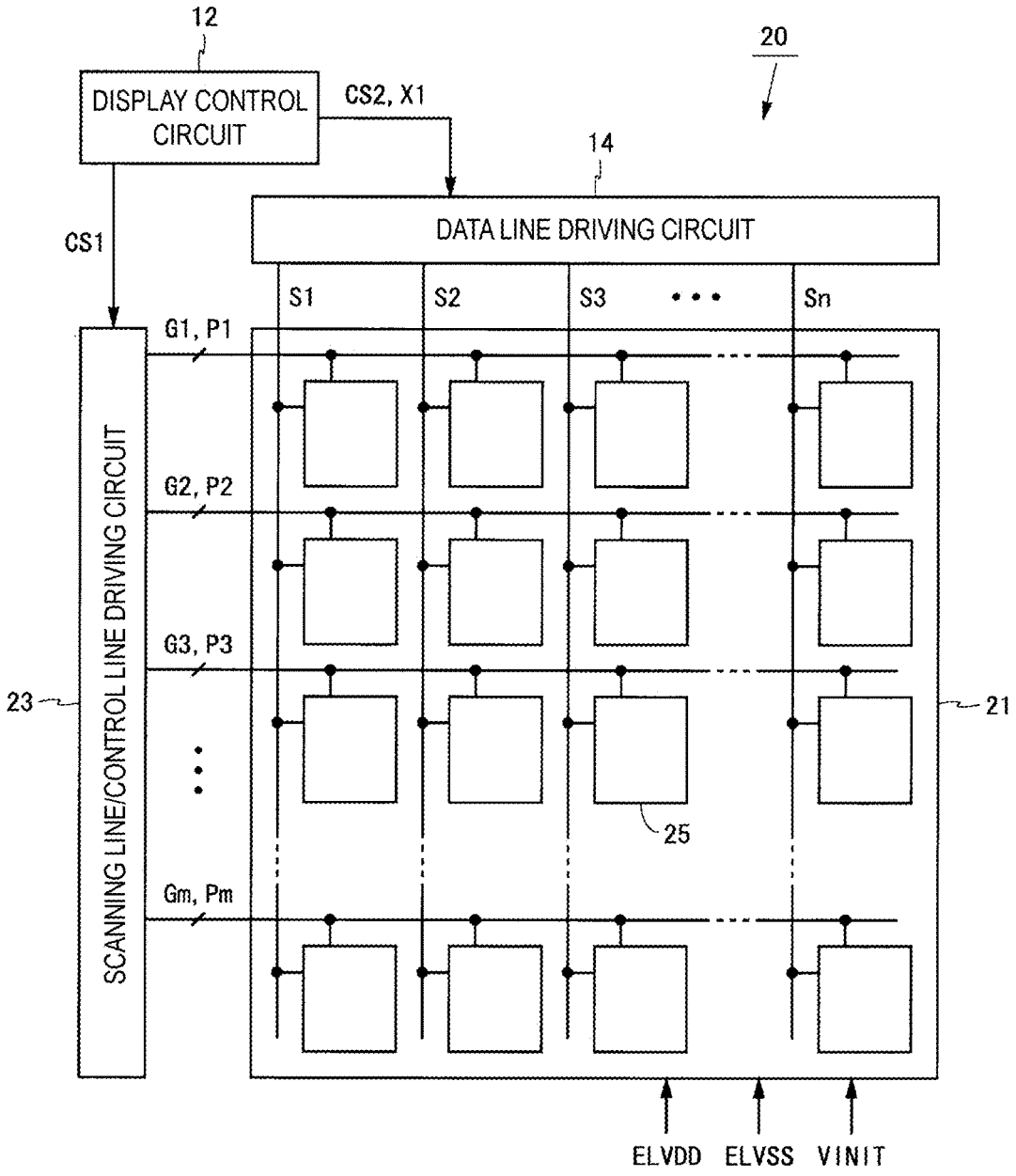
FIG. 4 is a block diagram illustrating a configuration of a display device according to a second embodiment.

FIG. 4 is a block diagram illustrating a configuration of a display device according to a second embodiment. A display device 20 illustrated in FIG. 4 includes a display portion 21, a display control circuit 12, a scanning line/control line drive circuit 23, and a data line drive circuit 14. Of all the components included in the present embodiment, those that are identical to their counterparts in the first embodiment will be denoted by the same reference signs as those used in the first embodiment, and no description for such components will be given below.

The display portion 21 includes: m scanning lines G1 to Gm; n data lines S1 to Sn; m control lines P1 to Pm; and (m×n) pixel circuits 25. The scanning lines G1 to Gm, the data lines S1 to Sn, the control lines P1 to Pm, and the (m×n) pixel circuits 25 are arranged in the same patterns as the patterns in the first embodiment. As in the first embodiment, three different voltages ELVDD, ELVSS, and VINIT are fixedly supplied to each of the pixel circuits 25. The scanning line/control line drive circuit 23 is a combination circuit that combines a scanning line drive circuit and a control line drive circuit. Based on the control signal CS1, the scanning line/control line drive circuit 23 drives the scanning lines G1 to Gm and the control lines P1 to Pm.

Figure 5:
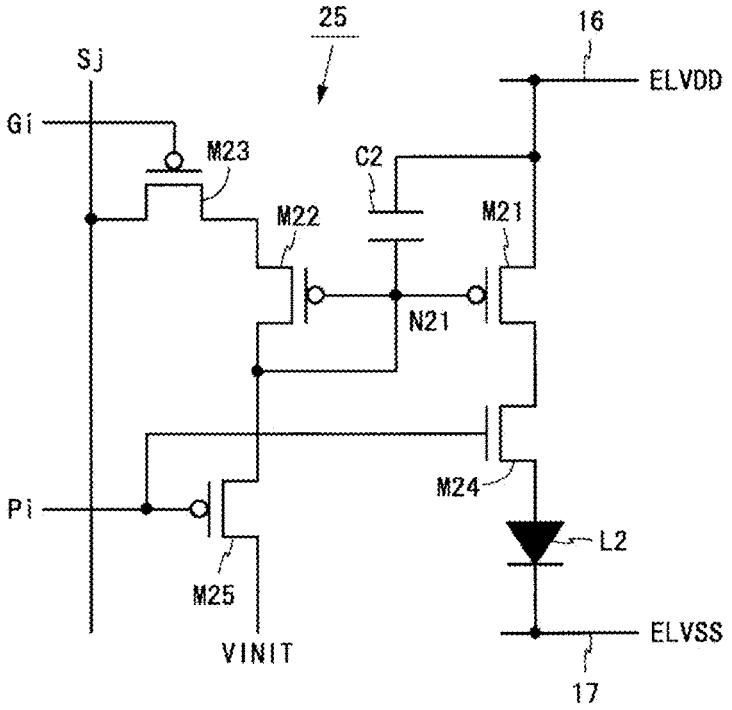
FIG. 5 is a circuit diagram illustrating a pixel circuit of the display device illustrated in FIG. 4.

FIG. 5 is a circuit diagram illustrating the pixel circuit 25. FIG. 5 illustrates a pixel circuit 25 located in the ith row and the jth column. The pixel circuit 25 illustrated in FIG. 5 includes: an organic EL element L2; five TFTs M21 to M25; and a capacitor C2. The pixel circuit 25 is connected to the scanning line Gi, the control line Pi, and the data line Sj. The TFT M24 is a N-channel transistor whereas the other TFTs are P-channel transistors.

The source terminal of the TFT M21 and a first one of the electrodes of the capacitor C2 (the upper-side electrode one in FIG. 5) are connected to a high-level power-source voltage wiring line 16 configured to supply the high-level power source voltage ELVDD. The drain terminal of the TFT M21 is connected to the drain terminal of the TFT M24. The source terminal of the TFT M24 is connected to the anode terminal of the organic EL element L2. The cathode terminal of the organic EL element L2 is connected to a common electrode 17 configured to supply the low-level power source voltage ELVSS. The TFT M23 includes a first conduction terminal (the left-hand side terminal in FIG. 5) connected to the data line Sj. The TFT M23 includes a second conduction terminal connected to a first conduction terminal of the TFT M22. The gate terminal of the TFT M21 is connected to a second one of the electrodes of the capacitor C2, the gate terminal of the TFT M22, a second conduction terminal of the TFT M22, and a first conduction terminal (the upper-side terminal in FIG. 5) of the TFT M25. The initialization voltage VINIT is applied to a second conduction terminal of the TFT M25. The gate terminal of the TFT M23 is connected to the scanning line Gi whereas the gate terminal of the TFT M24 and the gate terminal of the TFT M25 are connected to the control line Pi. The gate terminal and the drain terminal of the TFT M22 are fixedly connected to each other, and thus the TFT M22 is always in a diode-connected state. Hereinafter, the node to which the gate terminal of the TFT M21 is connected is referred to as a "node N21".

The organic EL element L2 is disposed on the route connecting the first and the second conductive members (i.e., the high-level power-source voltage wiring line 16 and the common electrode 17) configured to supply their respective power source voltages. The organic EL element L2 thus functions as an electro-optical element configured to emit light of luminance in accordance with the amount of electric current that flows through the route. The TFT M21 is disposed on the route in series with the electro-optical circuit, and functions as a driving transistor configured to regulate the amount of electric current flowing through the route. The TFT M23 functions as a writing control transistor whose first conduction terminal is connected to the data line Sj and whose control terminal is connected to the scanning line Gi. The TFT M25 functions as an initialization transistor whose first conduction terminal is connected to the control terminal of the driving transistor, whose second conduction terminal is applied with the initialization voltage VINIT, and whose control terminal is connected to a first control line (i.e., the control line Pi). The writing control transistor and the initialization transistor have the same polarity.

The driving transistor includes a first conduction terminal connected to the first conductive member. TFT M22 functions as a threshold compensation transistor whose first conduction terminal is connected to the second conduction terminal of the writing control transistor, whose second conduction terminal and whose control terminal are connected to the control terminal of the driving transistor. The TFT M24 functions as a light-emission control transistor whose first conduction terminal is connected to the second conduction terminal of the driving transistor, whose second conduction terminal is connected to a first one of the terminals of the electro-optical circuit, and that is complementarily conducted to the initialization transistor. The capacitor C2 is disposed between the first conductive member and the control terminal of the driving transistor.

Figure 6:
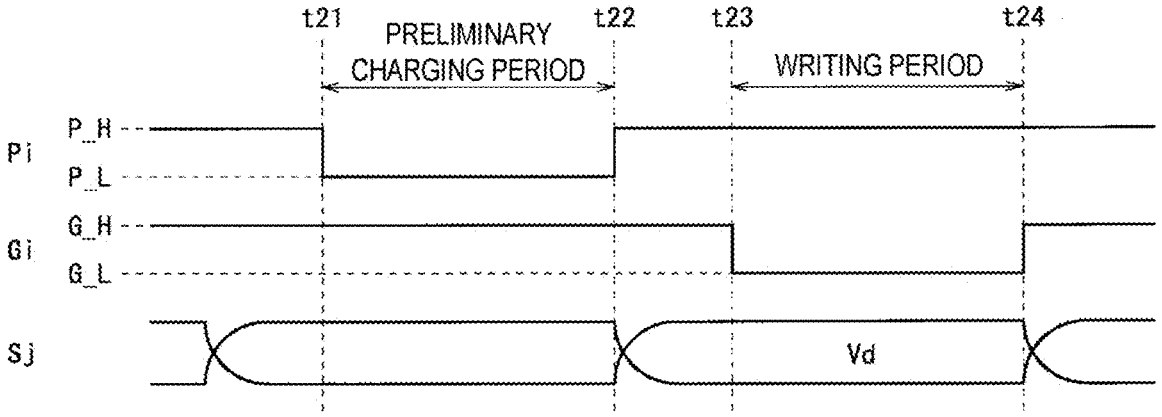
FIG. 6 is a timing chart for the display device illustrated in FIG. 4.

FIG. 6 is a timing chart for the display device 20. FIG. 6 illustrates the voltage changes at the time when data voltage is inputted into a pixel circuit 25 located in the ith row and jth column. In FIG. 6, the period from the time t21 to the time t22 is a preliminary charging period, whereas the period from the time t23 to the time t24 is a writing period.

As illustrated in FIG. 6, the control signal Pi is at the low level during the preliminary charging period, and is at the high level during the other period. The scanning signal Gi is at the low level during the writing period, and is at the high level during the other period. While the scanning signal Gi is at the high level, the organic EL element L2 in each of the pixel circuits 25 in the ith row emits light of the luminance in accordance with the data voltage inputted into the pixel circuits 25.

Prior to the time t21, the scanning signal Gi and the control signal Pi are at the high level. Hence, the TFTs M23 and M25 are in the OFF state, whereas the TFT M24 is in the ON state. During the above-described period, in a case where the TFT M21 has a gate-source voltage of not higher than the threshold voltage, a current flows from the high-level power-source voltage wiring line 16 to the common electrode 17 through the TFTs M21 and M24 as well as through the organic EL element L2. Hence, the organic EL element L2 emits light of the luminance in accordance with the electric current that flows.

At the time t21, the control signal Pi is switched to the low level. In response to the switching, the TFT M24 is turned OFF and the TFT M25 is turned ON. Hence, from the time t21 onwards, no electric current flows through the organic EL element L2, and thus the organic EL element L2 emits no light at all. Hence, the gate voltage of the TFT M21 is initialized to the initialization voltage VINIT.

Then at the time t22, the control signal Pi is switched to the high level. In response to the switching, the TFT M24 is turned ON and the TFT M25 is turned OFF. Hence, from the time t22 onwards, no initialization voltage VINIT is applied to the gate terminal of the TFT M21. In addition, as in the period before the time t21, in a case where the TFT M21 has a gate-source voltage that is not higher than the threshold voltage, an electric current flows through the organic EL element L2 and makes the organic EL element L2 emit light.

Then at the time t23, the scanning signal Gi is switched to the low level. In response to the switching, the TFT M23 is turned ON. Consequently, an electric current flows from the data line Sj to the gate terminals of the TFTs M21 and M22 through the TFTs M23 and M22. The gate voltages of the TFTs M21 and M22 are raised by this electric current. Once the gate-source voltage of the TFT M22 reaches the threshold voltage of the TFT M22, no electric current flows.

The gate voltages of the TFTs M21 and M22 a sufficient time after the time t23 is represented by (Vd−|Vth_M22|), where Vth_M21 (<0) is the threshold voltage of the TFT M21, and, Vth_M22 (<0) is the threshold voltage of the TFT M22, and Vd is the data voltage during the writing period.

Then at the time t24, the scanning signal Gi is switched to the high level. In response to the switching, the TFT M23 is turned OFF. From the time t24 onwards, the capacitor C2 keeps the inter-electrode voltage (ELVDD−Vd+|Vth_M22|). In addition, an electric current flows from the high-level power-source voltage wiring line 16 to the common electrode 17 through the TFTs M21 and M24 as well as through the organic EL element L2. The gate-source voltage Vgs of the TFT M21 is kept at (ELVDD−Vd+|Vth_M22|) by the operation of the capacitor C2. Hence, the electric current I2 that flows from the time t24 onwards is given by Equation (5) below with a constant K:

$$I2=K(Vgs-|Vth_M21|)^2=K(\mathrm{ELVDD}-Vd+|Vth_M22|-|Vth_M21|)^2 \quad (5)$$

Assuming that the threshold voltage Vth_M21 of the TFT M21 is equal to the threshold voltage Vth_M22 of the TFT M22, Equation (6) below is derived from the equation (5):

$$I2=K(\mathrm{ELVDD}-Vd)^2 \quad (6)$$

Hence, from the time t24 onwards, the organic EL element L2 emits light of luminance in accordance with the data voltage Vd inputted into the pixel circuit 25 irrespective of the threshold voltage Vth_M21 of the TFT M21.

In the display device 20, as in the case of the first embodiment, the high-level voltage P_H is set to a value that is lower than the high-level voltage G_H (P_H<G_H). To put it differently, in comparison to the off-voltage G_H to be given to the control terminal of the writing control transistor (i.e., TFT M23), the off-voltage P_H to be given to the control terminal of the initialization transistor (i.e., TFT M25) is set relatively close to the on-voltage (i.e., low-level voltage).

Hence, as in the case of the first embodiment, the display device 20 according to the present embodiment reduces the variation in the off-current for the initialization transistor (i.e., TFT M25) configured to initialize the voltage of the control terminal of the driving transistor (i.e., gate terminal of the TFT M21), and thus suppresses the occurrence of bright spots on the display screen.

Third Embodiment

Figure 7:
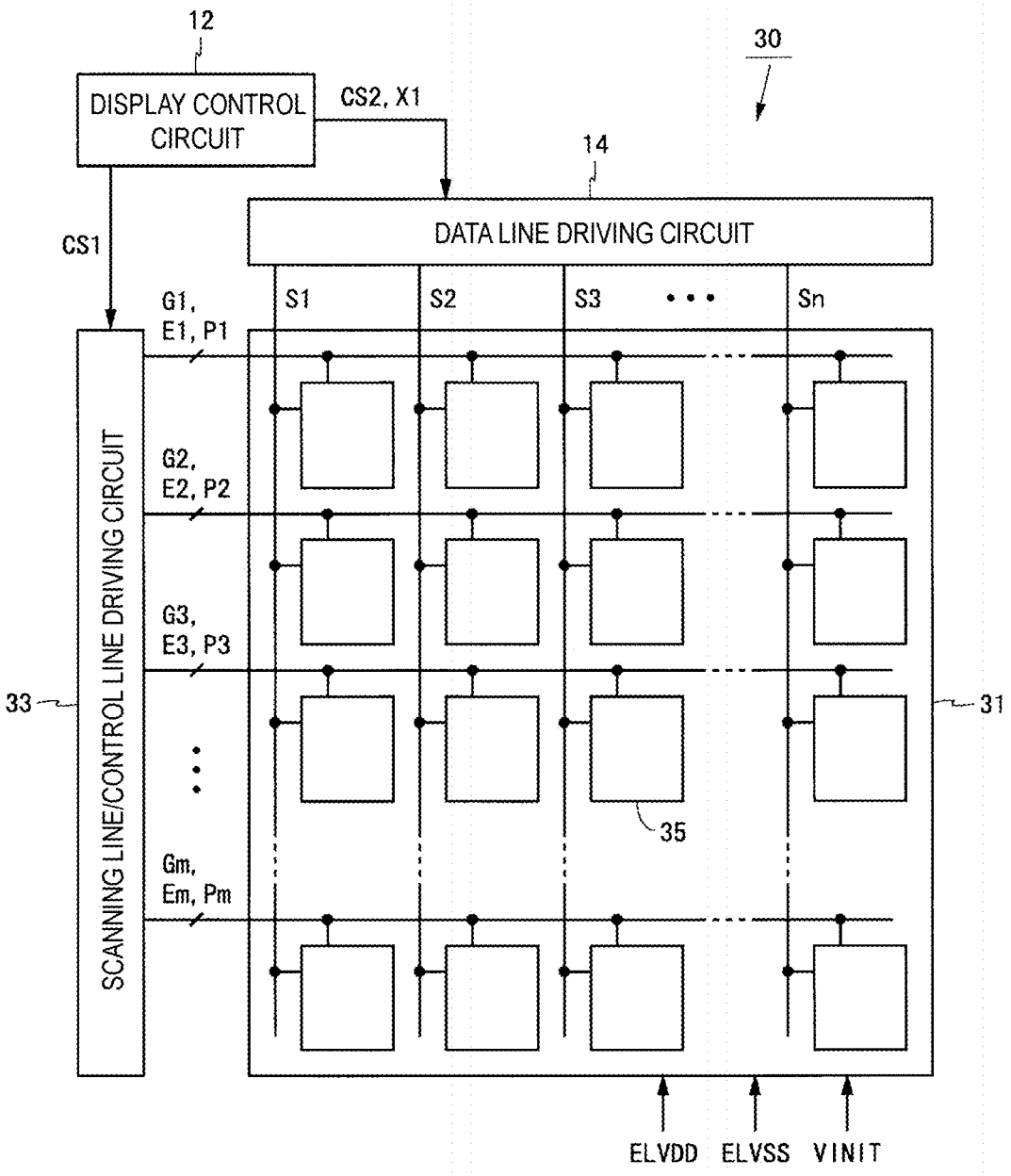
FIG. 7 is a block diagram illustrating a configuration of a display device according to a third embodiment.

FIG. 7 is a block diagram illustrating a configuration of a display device according to a third embodiment. A display device 30 illustrated in FIG. 7 includes a display portion 31, a display control circuit 12, a scanning line/control line drive circuit 33, and a data line drive circuit 14. Of all the components included in the present embodiment, those that are identical to their counterparts in the first and second embodiments will be denoted by the same reference signs as those used in the first and second embodiments, and no description for such components will be given below.

The display portion 31 includes: m scanning lines G1 to Gm; n data lines S1 to Sn; 2*m* control lines E1 to Em and P1 to Pm; and (m×n) pixel circuits 35. The scanning lines G1 to Gm, the data lines S1 to Sn, the control lines E1 to Em and P1 to Pm, and the (m×n) pixel circuits 35 are arranged in the same patterns as the patterns in the first embodiment. As in the first and second embodiments, three different voltages ELVDD, ELVSS, and VINIT are fixedly supplied to each of the pixel circuits 35. The scanning line/control line drive circuit 33 is a combination circuit that combines a scanning line drive circuit and a control line drive circuit. Based on the control signal CS1, the scanning line/control line drive circuit 33 drives the scanning lines G1 to Gm and the control lines E1 to Em and P1 to Pm.

Figure 8:
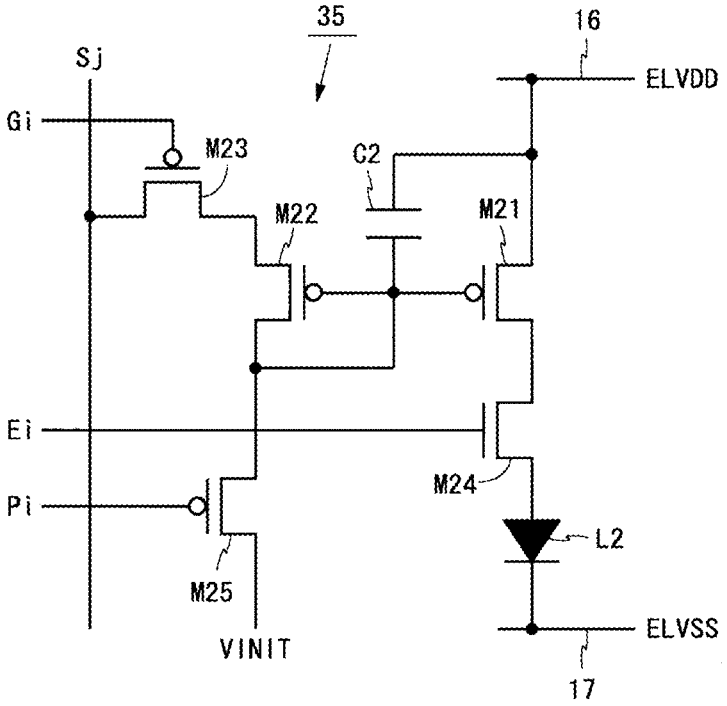
FIG. 8 is a circuit diagram illustrating a pixel circuit of the display device illustrated in FIG. 7.

FIG. 8 is a circuit diagram illustrating the pixel circuit 35. FIG. 8 illustrates a pixel circuit 35 located in the ith row and the jth column. The pixel circuit 35 illustrated in FIG. 8 has a substantially identical configuration with the configuration of the pixel circuit 25 according to the second embodiment.

The pixel circuit 35 includes: an organic EL element L2; five TFTs M21 to M25; and a capacitor C2. The pixel circuit 35 is connected to the scanning line Gi, the control lines Ei and Pi, and the data line Sj. The gate terminal of the TFT M24 is not connected to the control line Pi but is connected to the control line Ei.

Figure 9:
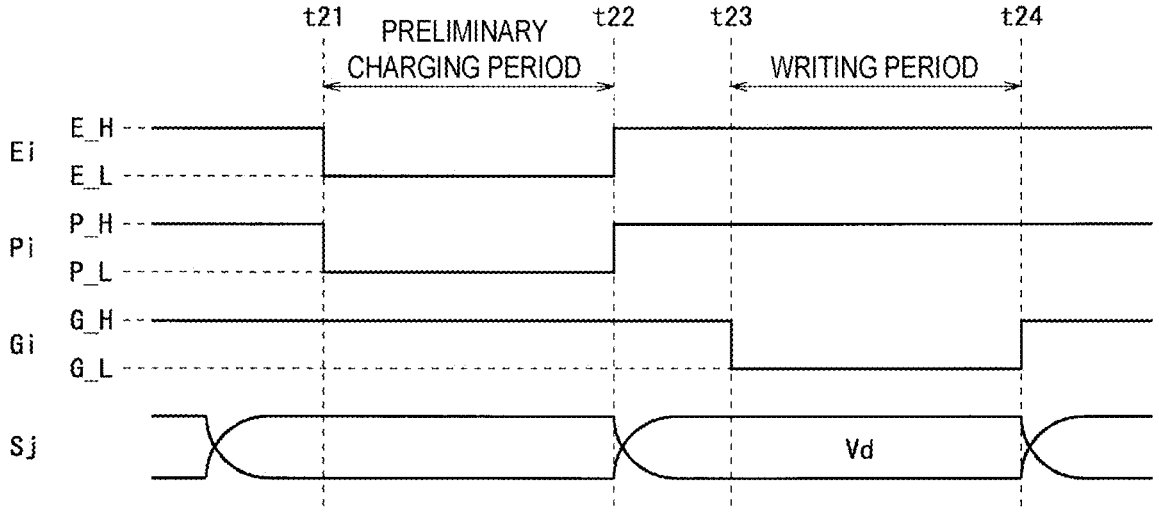
FIG. 9 is a timing chart for the display device illustrated in FIG. 7.
Figure 10:
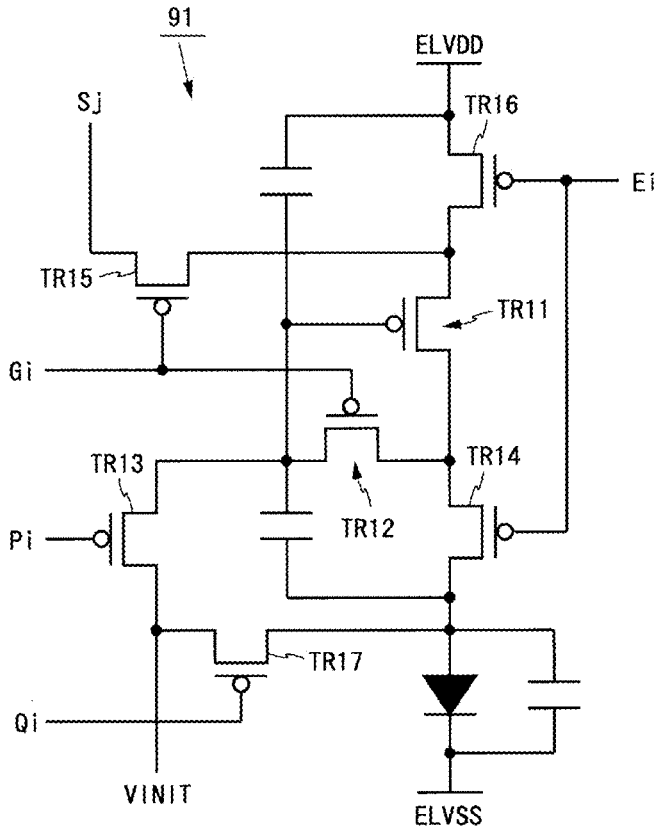
FIG. 10 is a circuit diagram illustrating a pixel circuit of a display device of a related art.
Figure 11:
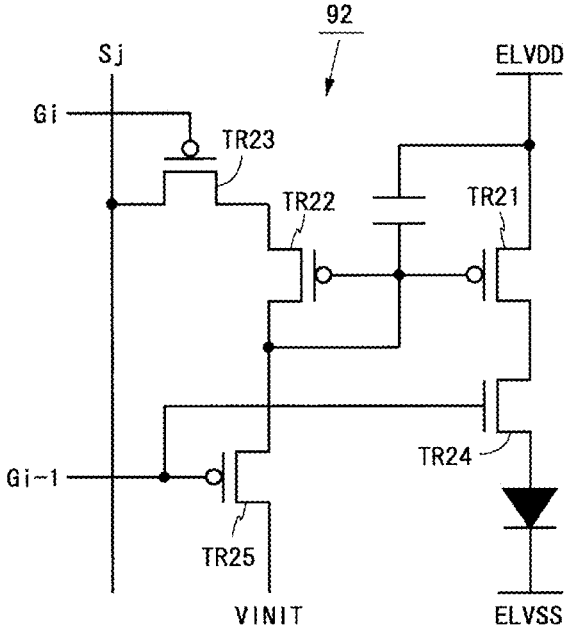
FIG. 11 is a circuit diagram illustrating a pixel circuit of a display device of a related art.

FIG. 9 is a timing chart for the display device 30. The timing chart illustrated in FIG. 9 is composed of the timing chart illustrated in FIG. 6 and additionally the changes in the voltage of the control signal Ei. As illustrated in FIG. 9, the control signal Ei is switched at the same timing and to the same direction as the timing and the direction of the control signal Pi. Hence, the pixel circuit 35 acts in a similar manner to the pixel circuit 25.

In the display device 30, as in the case of the first and second embodiments, the high-level voltage P_H is set to a value that is lower than the high-level voltage G_H (P_H<G_H). Hence, as in the case of the first and second embodiments, the display device 30 according to the present embodiment reduces the variation in the off-current for the initialization transistor (i.e., TFT M25) configured to initialize the voltage of the control terminal of the driving transistor (i.e., gate terminal of the TFT M21), and thus suppresses the occurrence of bright spots on the display screen.

In addition, in the display device 30, the high-level voltage P_H to be applied to the control line P1 to Pm is set to a value that is lower than the high-level voltage to be applied to the control line E1 to Em (hereinafter denoted by E_H) (P_H<E_H). Hence, the display device 30 according to the present embodiment maintains the on-voltage of the TFT M24 even when the high-level voltage P_H is lowered.

Various modifications can be made to the display devices according to the first to third embodiments. The description in each of the first to third embodiments is based on a display device including a pixel circuit with a particular configuration, but a display device may include a different pixel circuit from the one described thus far as long as the pixel circuit includes an organic EL element, a driving transistor, a writing control transistor, and an initialization transistor. As in the cases of the first to third embodiments, in a case where the driving transistor and the writing control transistor are P-channel transistors, the high-level voltage to be given to the control terminal of the initialization transistor is set to a value that is lower than the high-level voltage to be given to the control terminal of the writing control transistor. In a case where the initialization transistor and the writing control transistor are N-channel transistors, the low-level voltage to be given to the control terminal of the initialization transistor is set to a value that is higher than the low-level voltage to be given to the control terminal of the writing control transistor. Such display devices have similar effects to the effects that the display devices according to the first to third embodiments have.

In addition, the description in each of the first to third embodiments is based on a case where an organic EL display device that includes a pixel circuit including an organic EL element (organic light emitting diode) is an exemplar display device that includes a pixel circuit including an electro-optical circuit. It is, however, allowable to configure, in a similar manner, an inorganic EL display device that includes a pixel circuit including an inorganic light emitting diode or a quantum-dot light emitting diode (QLED) display device that includes a pixel circuit including a quantum-dot light emitting diode.

REFERENCE SIGNS LIST

10, 20, 30 Display device
11, 21, 31 Display portion
12 Display control circuit
13, 23, 33 Scanning line/control line drive circuit
14 Data line driving circuit
15, 25, 35 Pixel circuit
16 High-level power-source voltage wiring line (first conductive member)
17 Common electrode (second conductive member)

The invention claimed is:

1. A display device comprising:

a display portion including a plurality of scanning lines, a plurality of data lines, a plurality of control lines, and a plurality of pixel circuits;

a scanning line drive circuit configured to drive the plurality of scanning lines;

a data line drive circuit configured to drive the plurality of data lines; and a control line drive circuit configured to drive the plurality of control lines, wherein each of the pixel circuits includes an electro-optical element disposed on a route connecting a first conductive member and a second conductive member and configured to emit light of a luminance in accordance with an electric current flowing through the route, both the first conductive member and the second conductive member being configured to supply a power source voltage, a driving transistor disposed on the route in series with the electro-optical element and configured to regulate an amount of the electric current flowing through the route, a writing control transistor including a first conduction terminal connected to a data line of the plurality of data lines and a control terminal connected to a scanning line of the plurality of scanning lines, and an initialization transistor including a first conduction terminal connected to a control terminal of the driving transistor, a second conduction terminal to which an initialization voltage is applied, and a control terminal connected to a first control line included in the plurality of control lines, the writing control transistor and the initialization transistor have the same polarity, an off-voltage to be given to the control terminal of the initialization transistor is closer to an on-voltage than an off-voltage to be given to the control terminal of the writing control transistor, the driving transistor includes a first conduction terminal connected to the first conductive member, and each of the plurality of pixel circuits further includes a threshold compensation transistor including a first conduction terminal connected to a second conduction terminal of the writing control transistor, and a second conduction terminal and a control terminal both of which are connected to the control terminal of the driving transistor, a light-emission control transistor including a first conduction terminal connected to a second conduction terminal of the driving transistor and a second conduction terminal connected to a first terminal of the electro-optical element, the light-emission control transistor being complementarily conducted to the initialization transistor, and a capacitor disposed between the first conductive member and the control terminal of the driving transistor, wherein the off-voltage to be given to the control terminal of the initialization transistor is set to a value whose difference from an on-voltage corresponds to an average value of all the threshold voltages of the driving transistors included in the display portion.

2. The display device according to claim 1, wherein the light-emission control transistor includes a control terminal connected to the first control line.

3. The display device according to claim 1, wherein the light-emission control transistor includes a control terminal connected to a second control line included in the plurality of control lines.

4. The display device according to claim 1, wherein the initialization transistor and the writing control transistor are P-channel transistors, and a high-level voltage given to the control terminal of the initialization transistor is lower than a high-level voltage given to the control terminal of the writing control transistor.

5. The display device according to claim 1, wherein the initialization transistor and the writing control transistor are N-channel transistors, and a low-level voltage given to the control terminal of the initialization transistor is higher than a low-level voltage given to the control terminal of the writing control transistor.

6. The display device according to claim 1, wherein the electro-optical element is an organic light emitting diode.

7. The display device according to claim 1, wherein the electro-optical element is any one of an inorganic light emitting diode and a quantum-dot light emitting diode.

8. A display device driving method for driving a display device that includes a display portion including: a plurality of scanning lines; a plurality of data lines; a plurality of control lines; and a plurality of pixel circuits, the display device driving method comprising:

driving the plurality of scanning lines;

driving the plurality of data lines; and driving the plurality of control lines, wherein each of the plurality of pixel circuits includes an electro-optical element disposed on a route connecting a first conductive member and a second conductive member and configured to emit light of a luminance in accordance with an electric current flowing through the route, both the first conductive member and the second conductive member being configured to supply a power source voltage, a driving transistor disposed on the route in series with the electro-optical element and configured to regulate an amount of the electric current flowing through the route, a writing control transistor including a first conduction terminal connected to a data line of the plurality of data lines and a control terminal connected to a scanning line of the plurality of scanning lines, and an initialization transistor including a first conduction terminal connected to a control terminal of the driving transistor, a second conduction terminal to which an initialization voltage is applied, and a control terminal connected to a first control line included in the plurality of control lines, the writing control transistor and the initialization transistor have the same polarity, an off-voltage to be given to the control terminal of the initialization transistor is closer to an on-voltage than an off-voltage to be given to the control terminal of the writing control transistor, the driving transistor includes a first conduction terminal connected to the first conductive member, and each of the plurality of pixel circuits further includes a threshold compensation transistor including a first conduction terminal connected to a second conduction terminal of the writing control transistor, and a second conduction terminal and a control terminal both of which are connected to the control terminal of the driving transistor, a light-emission control transistor including a first conduction terminal connected to a second conduction terminal of the driving transistor and a second conduction terminal connected to a first terminal of the electro-optical element, the light-emission control transistor being complementarily conducted to the initialization transistor, and a capacitor disposed between the first conductive member and the control terminal of the driving transistor, wherein the off-voltage to be given to the control terminal of the initialization transistor is set to a value whose difference from an on-voltage corresponds to an average value of all the threshold voltages of the driving transistors included in the display portion.

9. The display device driving method according to claim 8, wherein the light-emission control transistor includes a control terminal connected to the first control line.

10. The display device driving method according to claim 8, wherein the light-emission control transistor includes a control terminal connected to a second control line included in the plurality of control lines.

11. The display device driving method according to claim 8, wherein the initialization transistor and the writing control transistor are P-channel transistors, and a high-level voltage given to the control terminal of the initialization transistor is lower than a high-level voltage given to the control terminal of the writing control transistor.

12. The display device driving method according to claim 8, wherein the initialization transistor and the writing control transistor are N-channel transistors, and a low-level voltage given to the control terminal of the initialization transistor is higher than a low-level voltage given to the control terminal of the writing control transistor.

13. The display device driving method according to claim 8, wherein the electro-optical element is an organic light emitting diode.

14. The display device driving method according to claim 8, wherein the electro-optical element is any one of an inorganic light emitting diode and a quantum-dot light emitting diode.

* * * * *